US006588104B2

(12) United States Patent
Heidrich

(10) Patent No.: US 6,588,104 B2
(45) Date of Patent: Jul. 8, 2003

(54) PROCESS FOR ASSEMBLING A STEAM GENERATOR

(75) Inventor: Jürgen Heidrich, Wolfachlugen (DE)

(73) Assignee: Alstom (Switzerland) Ltd., Baden (CH)

( * ) Notice: Subject to any disclaimer, the term of this patent is extended or adjusted under 35 U.S.C. 154(b) by 0 days.

(21) Appl. No.: 09/815,736

(22) Filed: Mar. 23, 2001

(65) Prior Publication Data

US 2001/0023665 A1 Sep. 27, 2001

(30) Foreign Application Priority Data

Mar. 24, 2000 (DE) ..... 100 14 758

(51) Int. Cl.[7] ..... B23P 15/00
(52) U.S. Cl. ..... 29/890.051; 29/890.03
(58) Field of Search ..... 29/890.051, 890.03, 29/428; 122/459, 460, 493, 494

(56) References Cited

U.S. PATENT DOCUMENTS 3,209,734 A * 10/1965 Cooper et al. ..... 122/510
3,644,978 A * 2/1972 Sullivan et al. ..... 29/726
3,667,429 A * 6/1972 Cross ..... 122/240.3
5,317,993 A * 6/1994 Payne ..... 122/510
5,339,891 A * 8/1994 Kidaloski et al. ..... 165/67
5,557,901 A * 9/1996 Hoosic et al. ..... 122/235.2
6,058,893 A * 5/2000 Patel ..... 122/493

* cited by examiner

*Primary Examiner*—I Cuda Rosenbaum
(74) *Attorney, Agent, or Firm*—Alix, Yale & Ristas, LLP

(57) ABSTRACT

During the assembly of a steam generator, the boiler columns are assembled, and, in parallel, headers and other wall boxes are assembled on booms of the boiler columns, so that when the boiler columns are completed, the headers and wall boxes are also finally assembled. Next, the peripheral roof section is assembled onto the boiler columns, and the vertical steam generator-containing walls are suspended from the peripheral roof section. Parallel to this, the inner roof section is constructed and the convection heating surfaces are successively mounted to the inner roof section and lifted upward from the base. The assembled inner roof section and convection heating surfaces are then lifted to the height of the peripheral roof section, and the two parts of the roof are connected. Finally, the furnace walls having a vertical or inclined tube arrangement, including the furnace hopper, are assembled.

11 Claims, 6 Drawing Sheets

PROCESS FOR ASSEMBLING A STEAM GENERATOR

BACKGROUND OF THE INVENTION

This invention relates generally to steam generators and processes for erecting steam generators. More particularly, the present invention relates to steam generators for thermal use of fossil fuels.

Today large steam generators are designed almost entirely as furnace wall steam generators. Their boiler wall is made as a furnace wall. The top part of the space enclosed by the boiler wall has interior components such as economizers, reheaters, superheaters, or other heat-exchange surfaces arranged in it. The boiler wall has buckstays and wall boxes on the outside, including headers arranged on cross-members. The lower end of the boiler wall has a boiler hopper attached to it. The entire boiler, including all the elements mentioned, is arranged so that it is suspended in a structural steelwork. The boiler structural steelwork, which stands on an appropriate foundation, has several boiler columns which are braced with one another by crossbeams and diagonal braces, and which bear a roof of the structural steelwork. The roof of the structural steelwork bears the boiler.

The steam generator is assembled at least partially at its installation site, which takes a relatively long time, due to the size of the plant and the scope of work. First the boiler structural steelwork, including the roof, is erected, after which the buckstays and, in the top part of the boiler, the boiler walls are brought from below to their installation site and installed there. The usual procedure then is for the interior components (heat recovery sections) also to be brought from below to their installation site between the boiler walls in the upper boiler area and installed there. Further assembly of the boiler wall is then done from top to bottom, with parallel assembly and assembly at different levels being mostly impossible. Therefore, the assembly of the upper boiler walls, the interior components, and the lower boiler walls is done in series, from the perspective of time. This is what determines the assembly time.

Concerning these problems, EP 0777080 B1 discloses a corresponding assembly process for steam generators, which involves beginning the assembly of the external boiler structural steelwork and a part of the boiler approximately simultaneously. Once the boiler structural steelwork has reached a certain minimum height, the boiler structural steelwork has hoisting equipment put into it to raise a roof of the structural steelwork, which up to then has been lying on the floor (base of structural steelwork), first to a first height. At this height the boiler components are assembled suspended below the boiler structural steelwork. As the building of the external boiler structural steelwork progresses, the hoisting equipment is moved upward and the roof of the boiler structural steelwork is also raised further, to make possible further assembly of the heat exchanger surfaces. After the boiler structural steelwork is completed, the boiler part suspended from the roof of the boiler structural steelwork that has been simultaneously assembled in this manner is raised upward, and the roof is attached to the boiler structural steelwork.

The boiler walls and interior components can only be assembled one after the other in time.

SUMMARY OF THE INVENTION

Starting from the above-described state of the art, it is the task of the invention to reduce the building time for steam generators.

This task is solved by the assembly process according to claim 1. Moreover, the task is solved with a steam generator according to claim 11, which allows a shortened building time.

The process according to the invention for assembling steam generators involves building interior components, such as economizers, superheaters, and similar heat recovery sections during the construction of the upper boiler wall at a location that is at a distance from the installation site. Therefore, they can be assembled simultaneously. The spatial distance allows each part of the assembly work to be carried out largely unimpeded. This temporally parallel way of working can save substantial building time. In the process, the boiler walls are assembled or installed at their final installation site.

A preferred embodiment involves first erecting only an outer part of the roof on the boiler structural steelwork. This outer part leaves an access opening free in the middle, which preferably is smaller than a horizontal section through the boiler. The crane can feed elements belonging to the upper part of the boiler wall, such as buckstays, wall boxes, and tube registers through this access opening to their respective installation sites. The lower part of the boiler structural steelwork and the boiler base are not needed for this purpose, so they are kept clear.

Accordingly, the boiler containing walls are erected, for example, by using a crane to raise individual buckstays and wall boxes, or buckstays and wall boxes that are preassembled, into the boiler structural steelwork, and suspending them there temporarily on the roof of the boiler structural steelwork or temporarily storing them in corresponding intermediate storage locations. Alternatively, the buckstays can be built at the same time that the upper part of the boiler structural steelwork is built.

After the buckstays and any possible wall boxes are assembled, tube registers for building the boiler wall can be raised from above by a crane into the inside space that is surrounded by the buckstays. Then, the tube registers are fastened to the roof of the boiler structural steelwork so that they are suspended, and they are welded together with one another. Furthermore, other connections can be made, e.g., to the buckstays and wall boxes.

While the individual buckstays, wall boxes, and tube registers are assembled in the upper boiler structural steelwork, an inner section of the roof of the boiler structural steelwork is built and/or kept ready on the base of the boiler structural steelwork. The outer section of the roof of the boiler structural steelwork also has hoisting equipment, for example a cable hoisting system, erected on it, whose traction mechanisms (cables) are connected with corresponding suspended parts of the inner roof section. In this preferred process variant, the preassembly of the boiler top casing as well as the assembly of the interior components (tubular coils for economizers, reheaters, and superheaters) takes place suspended under the inner section of the roof of the boiler structural steelwork. In the process, the interior components are anchored with sling tubes under the roof of the boiler structural steelwork so that they are suspended from it. Thus, simultaneously with the erection of the boiler walls of the upper area of the boiler, a structural unit is constructed from the roof of the boiler structural steelwork, the boiler top casing, and the interior components. The cable hoisting system can then be used to raise the inner section of the roof of the boiler structural steelwork step by step, each time far enough so that each next unit from top to bottom can be assembled. After partial assembly, all that then remains is to raise this unit by means of the cable hoisting system until the interior components reach their installation position and the inner roof section is raised to the height of the roof of the boiler structural steelwork. After the spatially separated but simultaneous assembly of the upper boiler wall and the interior components, the two are united by raising the interior components from below.

Thus, the two building site areas for the upper boiler wall and the interior components are arranged vertically above one another, separate from one another, and at a distance from one another. The boiler structural steelwork roof is divided into an outer roof section and an inner roof section. The outer section of the roof of the boiler structural steelwork bears the boiler walls with their buckstays and wall boxes, as well as the inner section of the roof of the boiler structural steelwork. The inner roof section in turn bears, through corresponding sling tubes, the interior components of the boiler. The outer roof section is assigned to the boiler structural steelwork and the boiler walls. The inner roof section is assigned to the interior components.

This assembly process is suitable both for once-through steam generators and for recirculating steam generators. It is also suitable both for boiler walls with vertical tube arrangements and for steam generators with inclined tube arrangements or for steam generators whose boiler walls have vertical and inclined tube arrangements. The assembly time of the steam generator can be shortened by several months.

For preassembly of the interior components, it is preferable to raise the inner section of the roof of the boiler structural steelwork in a stepwise manner to make it possible to assemble, in top to bottom sequence, the various interior components and correspondingly also their sling tubes. This makes it possible to erect several economizer heating coils, reheater heating coils, and superheater heating coils in a stepwise manner above one another. The spatial separation of the building sites of the top boiler walls and the interior components brings not only a gain in time, but also a substantial improvement in the assembly logistics. Feeding the parts of the top boiler wall from above means that the base of the structural steelwork remains clear for building the interior components.

The steam generator according to the invention has a divided roof of the boiler structural steelwork. Its inner roof section is dimensioned such that it, together with interior components that are suspended from it, can be moved through the inside space bordered by the boiler walls. Thus, the outside dimensions of the inner section of the roof of the boiler structural steelwork are smaller than the cross section of the space enclosed by the boiler walls. The same goes for the interior components such as economizers, reheaters, and superheaters. For this purpose, it is preferable for them to have assembly connections which lie inside the space enclosed by the boiler walls. It is preferable for assembly to be done by welding to wall penetrations or joining pipes.

The inner section of the roof of the boiler structural steelwork forms, together with the interior components that are mounted to it and possibly a boiler top casing, a preassembled subassembly. It is then possible to put it as a whole between the already assembled furnace walls and into its installation site and connect it there. This manner of building has substantial assembly advantages, since it allows simultaneous assembly or preassembly of the boiler containing walls and the interior components at separate locations.

When the building of the steam generator has been completed, the inner roof section is connected with the outer roof section. This can be done with bolt connections, or it can also be done with non-detachable means of connection, such as rivets and welding connections.

The boiler structural steelwork and/or the outer section of the roof of the boiler structural steelwork can have hoisting equipment on it if necessary, and it can be temporary. It then forms a hoisting system to raise the inner section of the roof of the boiler structural steelwork in steps during preassembly, until all interior components have been suspended from the inner section of the roof of the boiler structural steelwork. After that, the hoisting system can be used to raise the subassembly that has been preassembled in this manner to its installation site and keep it there until other means hold the structural unit in its location and, for example, the inner roof section is connected with the outer roof section.

After this assembly step, the hoisting system can be removed, if necessary. The hoisting system can work either by pulling from above or by pushing from below. Furthermore, several hoisting system can work together.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
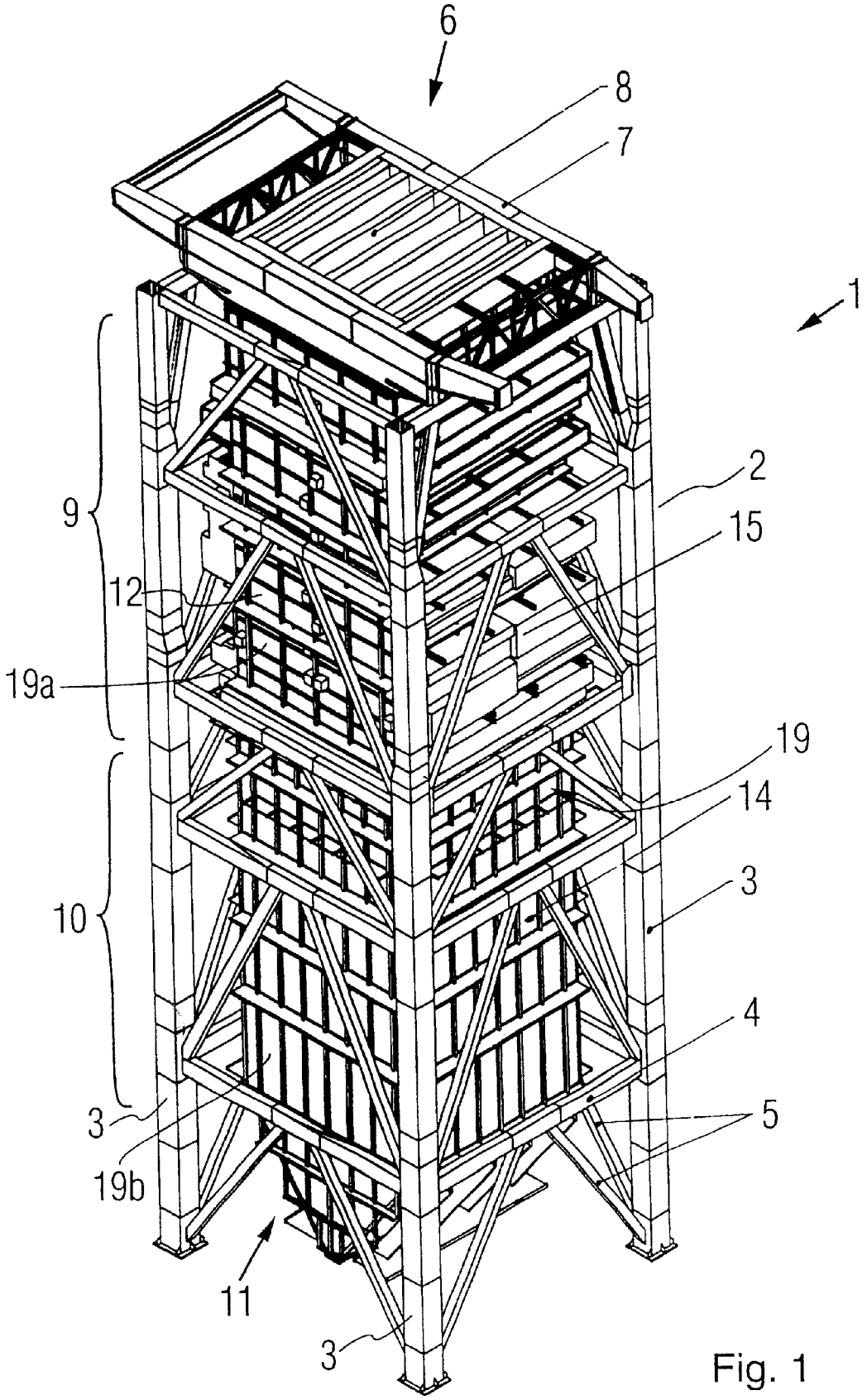
FIG. 1 is a schematic perspective view of an essentially completely assembled flue gas pass of a steam generator.

FIG. 1 shows a steam generator 1 in tower style which is borne by a boiler structural steelwork 2. Boiler structural steelwork 2 includes vertically arranged boiler columns 3, which rest on corresponding foundations. The boiler columns 3 that are set up in a rectangle and vertically arranged are connected to one another by horizontal boiler structural steelwork beams 4, which are arranged in tiers. To reinforce the boiler structural steelwork 2, diagonal braces 5 of the boiler structural steelwork are provided. On its top side, the boiler structural steelwork 2 bears a roof 6, which is divided into an outer roof section 7 and an inner roof section 8. The outer roof section 7 rests on the boiler structural steelwork 2 and is connected with it. The inner roof section 8 is borne by the outer roof section 7 and is connected with it. The outline, i.e., the maximum outside outer dimensions of the inner roof section 8, is at least somewhat smaller than the inside clearance of the space in the steam generator 1 enclosed by a boiler wall 19, at least in its upper section 9. In this section, the illustrated steam generator 1 has a vertical tube arrangement (boiler wall 19*a* in the upper section).

Section 9 of steam generator 1 has interior components in the space enclosed by the boiler wall 19, including an economizer, reheaters, and superheaters. Each of these is formed by a horizontally arranged tube bundle which extends transversely through a flue gas pass 13 that extends through the steam generator 1 and whose connections pass through the furnace wall (which forms the boiler wall). The interior components have the so-called heat recovery sections formed on them. The interior components are held suspended on the roof 6 of the boiler structural steelwork by vertical sling tubes. Outside, the boiler wall 19 is enclosed by buckstays 12, which support the boiler wall on the outside and are borne by the boiler wall 19. The buckstays are connected with one another and with the boiler wall 19 at the boiler corner areas. Moreover, the buckstays 12 that extend horizontally and are formed by stiff beams are connected with one another by vertical beams, so-called stays.

In another section 10 lying below, the steam generator has an inclined tube arrangement (boiler wall 19*b* in section 10). However, if necessary a different tube arrangement can also be selected. The parts of the boiler wall 19 with an inclined tube arrangement in turn have buckstays 14, which support boiler wall 19*b* on the outside outward and are borne by it. Toward the bottom a boiler hopper 11 is connected, which also has buckstays.

Figure 5:
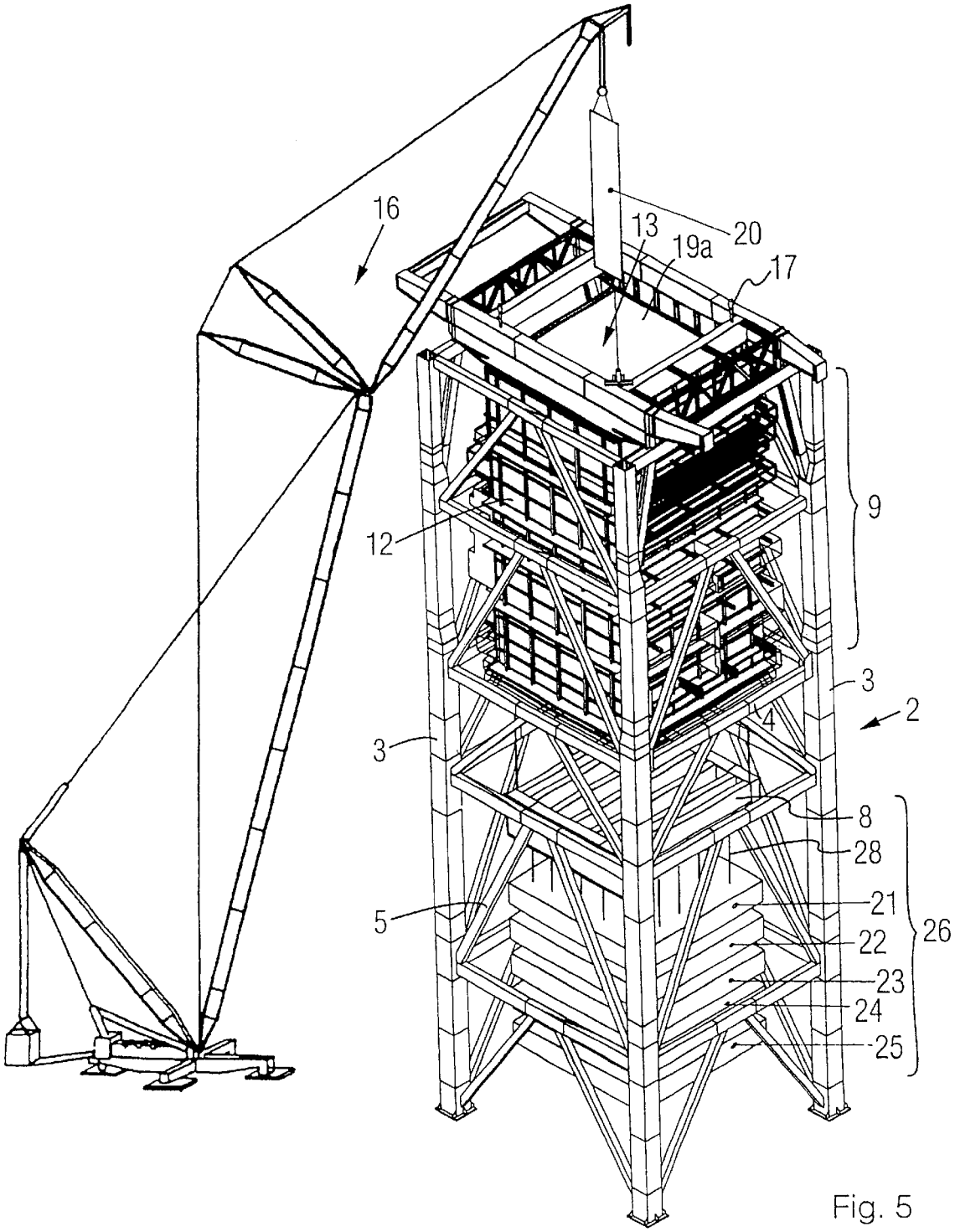
FIG. 5 is a schematic perspective view of a phase of construction which is subsequent to that shown in FIG. 4, in which the boiler walls and heat recovery sections are being assembled simultaneously.
Figure 6:
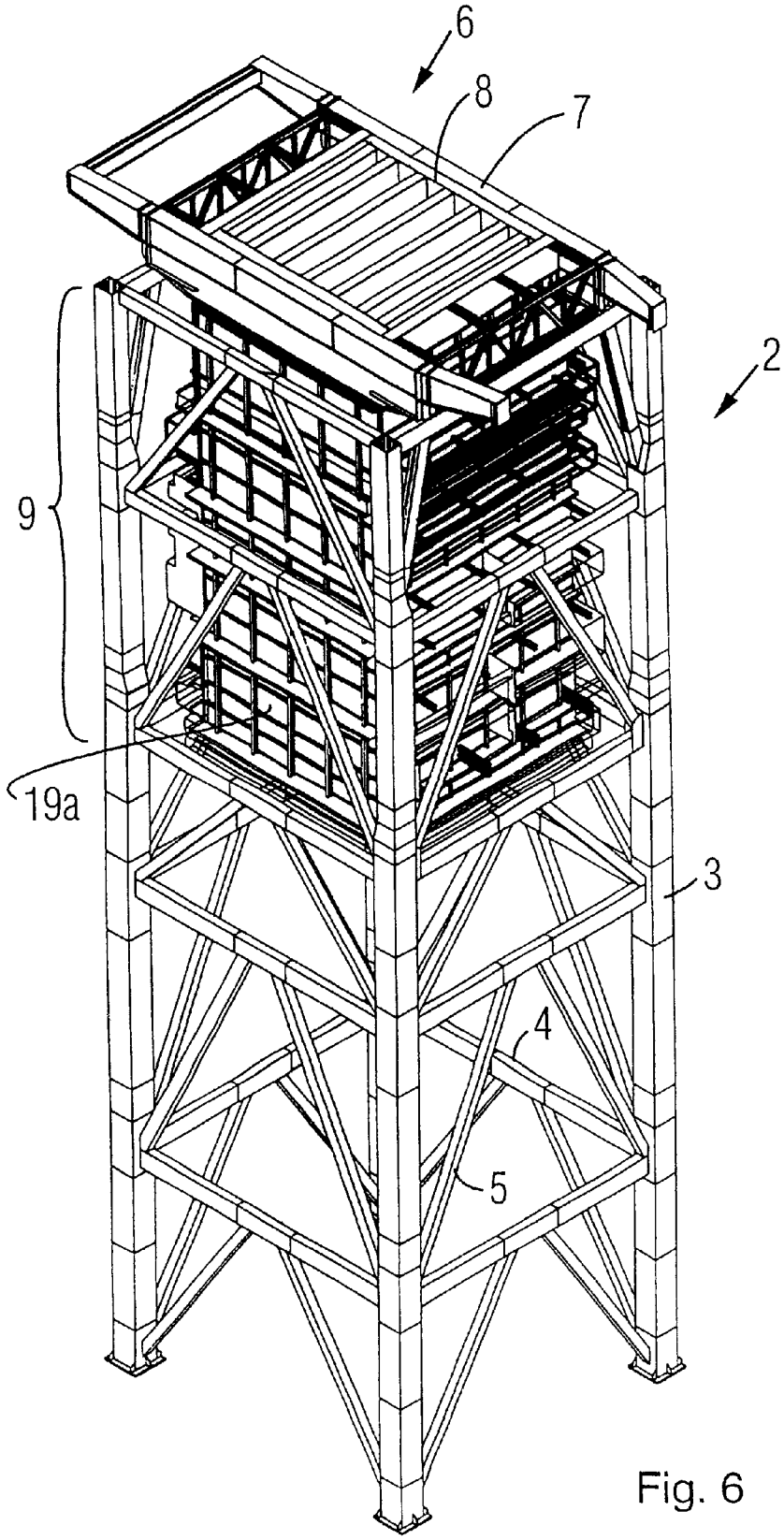
FIG. 6 is a schematic perspective view of a phase of construction which is subsequent to that shown in FIG. 5, in which the preassembled heat recovery sections are raised into the installation position and fixed there.

The steam generator 1 has at least one flue gas pass 13 (FIG. 5). This is bordered by furnace walls which are mounted suspended on the roof 6 of the boiler structural steelwork and bear the buckstays 12, 14. The flue gas pass also has wall boxes 15 mounted on the outside. The wall boxes including, e.g., headers, are held on cross-members, each of which is held at one end by the boiler wall 19 and at its other end on sling tubes 28 (FIG. 5), which are also held on the roof 6 of the boiler structural steelwork. The entire boiler made in this way is suspended from the roof 6 of the boiler structural steelwork.

The steam generator 1, which has been illustrated so far in an overview manner, is erected in the sequence illustrated in FIGS. 2 through 6.

Figure 2:
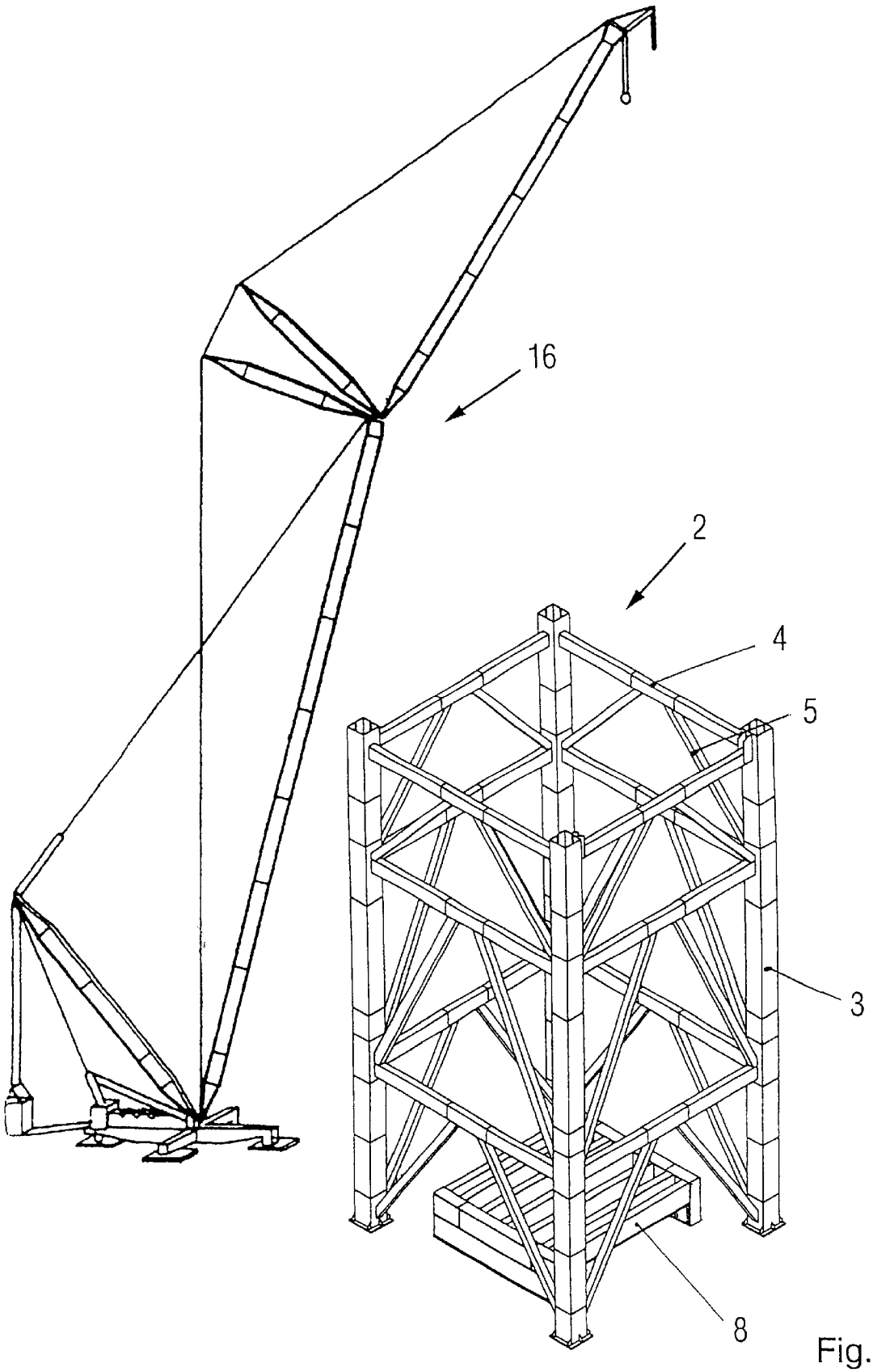
FIG. 2 is a schematic perspective view of partially erected external boiler structural steelwork and the already erected inner section of the roof of the boiler structural steelwork, as well as an assembly crane.

As is shown in FIG. 2, work begins with the assembly of the boiler structural steelwork 2, which involves building the boiler structural steelwork columns 3 and the associated beams 4 and diagonals 5 of the boiler structural steelwork tier by tier. This assembly is done with a crane 16 or with several cranes. Simultaneously, the inner roof section 8 is preassembled on the base of the boiler structural steelwork or is brought to this place in already preassembled state. Here the roof section 8 lies midway between the boiler structural steelwork columns 3, which are set up in a square or rectangle. It is preferable for the inner roof section 8 to have a rectangular or square outline, which corresponds to the cross section of the flue gas pass 13, but which is somewhat smaller than it.

Figure 3:
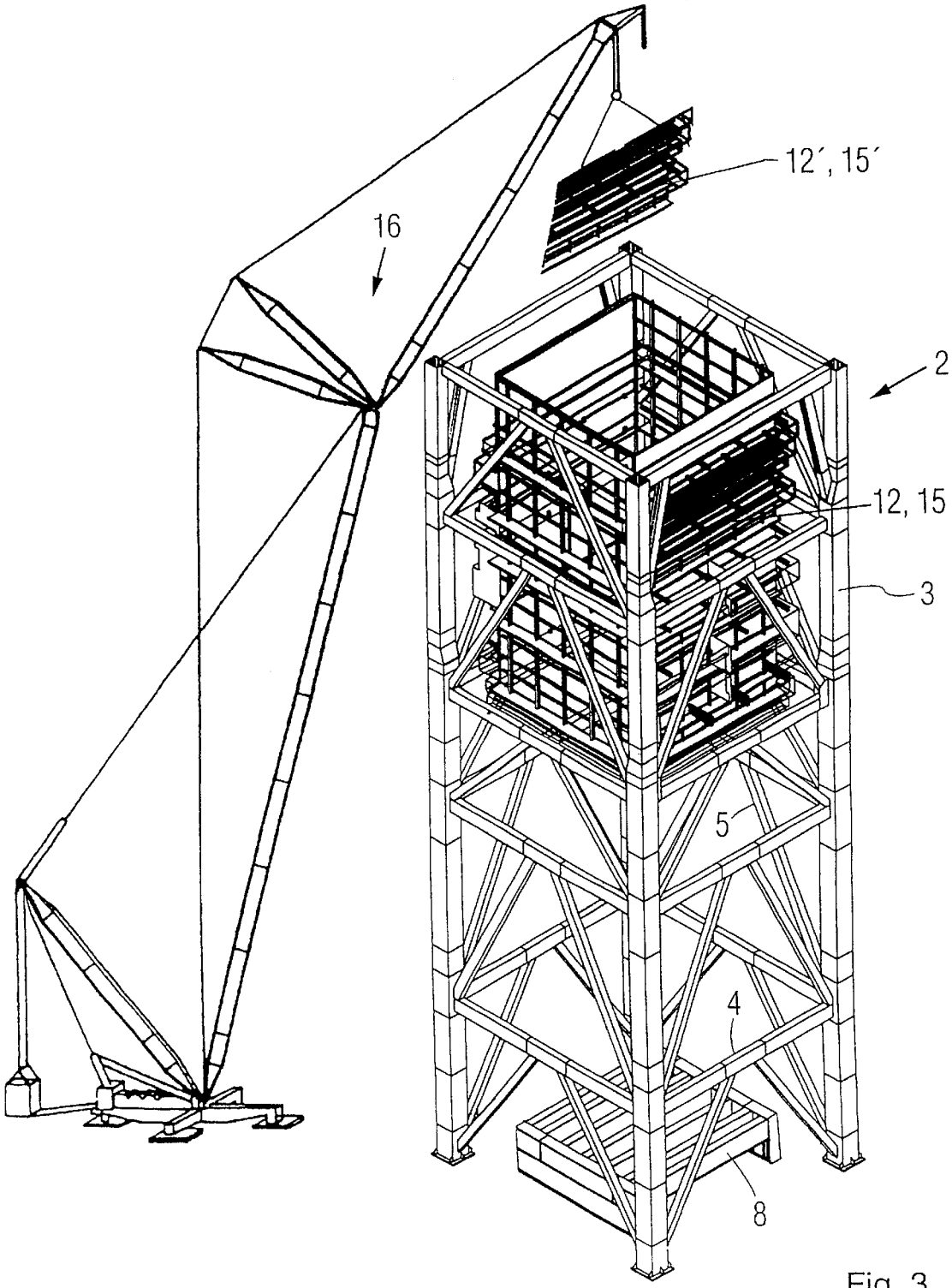
FIG. 3 is a schematic perspective view of a phase of construction of the boiler structural steelwork which is subsequent to that shown in FIG. 2, with buckstays and wall boxes already partially assembled.

A second work step is illustrated in FIG. 3. Here, as the further building of the boiler structural steelwork 2 progresses, when the boiler columns 3 have reached their desired height or at least a certain minimum height, the assembly of the individual buckstays 12 and wall boxes 15 begins. The crane 16 raises them as preassembled buckstays and wall boxes 12', 15' from above into or onto the boiler structural steelwork 2 and installs them there. When the assembly of the buckstays 12 is completed, they are borne by the boiler wall 19, and thus ultimately by the roof 6 of the boiler structural steelwork, but during assembly they can first be temporarily stored on auxiliary beams which are borne by crossbeams 4.

Figure 4:
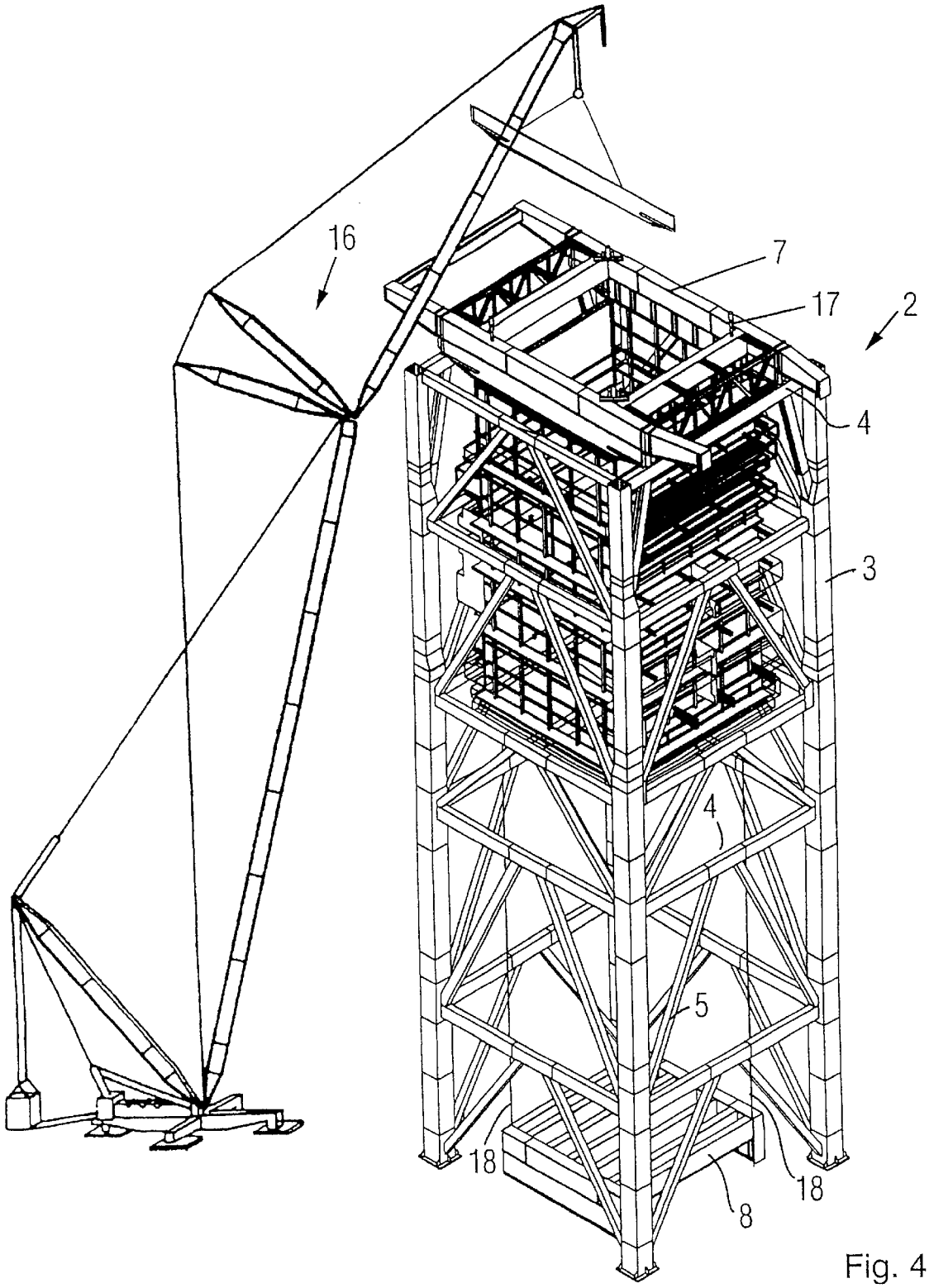
FIG. 4 is a schematic perspective view of a phase of construction which is subsequent to that shown in FIG. 3, in which an outer section of the roof of the boiler structural steelwork, including a cable hoisting system, has also been assembled.

FIG. 4 shows how it is possible, if the buckstays and wall boxes 12, 15 are assembled or preassembled, to complete the boiler structural steelwork 2, if this has not yet been done, and then to assemble the outer roof section 7 on boiler structural steelwork 2, in particular on its upper beams 4. To do this, the crane 16 sets corresponding parts onto the boiler structural steelwork 2, so that the outer roof section 7 is assembled at its installation site.

The outside roof section 7 also has a cable hoisting system 17 mounted on it, which includes several cable hoisting devices, each of whose pulling cable bundle 18 can be connected with the corners of the inner roof section 8.

This construction section essentially completes the building of the boiler structural steelwork 2, and it is now possible to begin simultaneous assembly of the boiler wall 19*a* in the upper section 9 and the building of the interior components beneath the inner roof section 8. This process is illustrated in FIG. 5. To build the boiler wall 19*a,* the crane 16 guides individual preassembled boiler wall parts 20 (pressure retaining members) from above into the space surrounded by the existing buckstays 12, and fastens them to the outer roof section 7 so that they are suspended. Thus, the boiler wall 19*a* is built by registers. The flue gas pass 13 that is bordered by it and whose top section 9 is already being produced keeps a clear cross section in the process.

Simultaneously with the installation of parts 20 to erect the boiler wall 19*a,* the interior components are being constructed in the lower section 10. To do this, the cable hoisting system 17 raises the inner roof section 8 step by step, each time raising it far enough and holding it at this height long enough that the interior components can be built. Once the inner roof section 8 of the boiler structural steelwork has been raised to a first height, first the boiler top casing is built under it and fastened to it so that it is suspended.

After that, the inner roof section 8 of the boiler structural steelwork is raised to a next assembly height, so that a first economizer heating coil 21 can be moved under the boiler top casing and fastened with the sling tubes 28 to the inner roof section. After further raising, a second economizer heating coil 22 follows. Now, the inner roof section 8 is raised each time in steps, and, as illustrated in FIG. 5, a first reheater coil 23 and a second reheater coil 24 are assembled one after the other, suspended on the sling tubes. After the inner roof section 8 is raised further, a superheater coil 25 arranged right at the bottom can be assembled.

Approximately simultaneously with the completion of making the boiler top casing and the assembly of the suspended interior components 21 through 25 (interior components), the boiler wall 19*a* is also completed in the mean time. The inner roof section, the boiler top casing, and the interior components occupy a somewhat cuboid space. The boiler walls 19*a* also enclose a cuboid space. However, at least its horizontal section is (at least somewhat) larger than the horizontal section of the space occupied by the interior components and the inner roof section 8.

In a next assembly step, illustrated in FIG. 5, component 26, consisting of the inner roof section 8 and coils 21 through 25 (interior components) as well as an inner boiler structural steelwork that is not further illustrated, is now raised and guided in this way from bottom to top into the flue gas pass between the boiler walls 19*a*. In the process, inner roof section 8 is brought up into a corresponding opening for it or brought up to a corresponding holding means of the outer roof section 7, and fixed here. For example, roof sections 7, 8 are bolted together with one another or welded together with one another. Interior components 21 through 25 are also connected (welded on).

After that, the boiler wall 19*b* with a vertical or inclined tube arrangement in section 10 and boiler hopper 11 are assembled to obtain the completed steam generator 1 shown in FIG. 1.

Thus, assembly is done according to new assembly logistics comprising the following steps:

1. Assembly of boiler structural steelwork 2 and, parallel to this, buckstays 12 and wall boxes 15;
2. Assembly of the heat recovery sections economizer coils (21, 22), reheater coils (23, 24), superheater coil (25), and simultaneously with this, assembly of the boiler wall (19*a*) in the upper section (9);
3. Assembly of the boiler wall 19*b* with an inclined tube arrangement that is arranged in the next (lower) section (10, FIG. 1); and
4. Assembly of the boiler hopper 11.

By contrast, the conventional assembly concept is as follows:

1. Boiler structural steelwork assembly;
2. Assembly of the buckstays and wall boxes;
3. Assembly of the tube arrangement (vertical tube arrangement);
4. Assembly of the heat recovery sections;
5. Assembly of the tube arrangement arranged beneath it (inclined tube arrangement); and
6. Assembly of the boiler hopper.

The novel assembly process of the new steam generator allows substantial time, and thus cost advantages.

In summary, it is maintained that during the assembly of a steam generator, first the boiler columns are assembled from bottom to top, and, parallel to this, headers and other wall boxes are assembled on booms of the boiler columns, so that when the boiler columns are completed, the headers and wall boxes are also finally assembled. Next, the peripheral roof section of the boiler structural steelwork is assembled onto the boiler columns, and the vertical steam generator-containing walls are suspended into the peripheral roof of the boiler structural steelwork. Parallel to this, during the continuous assembly period, the inner roof section of the boiler structural steelwork is constructed and the convection heating surfaces (economizers, superheaters) are installed by successive lifting from the 0 m level (structural steelwork base) upward to the inner roof section of the boiler structural steelwork. The entire package that has been completed in this manner is raised, after the assembly of the peripheral devices (boiler columns, headers, and wall boxes, vertical furnace containing walls, peripheral roof section of the boiler structural steelwork) has been completed, to the height of the peripheral roof section of the boiler structural steelwork, and the two parts of the roof of the boiler structural steelwork, which have been separate up to now, are connected. Finally, the furnace walls having a vertical or inclined tube arrangement, including the furnace hopper, are assembled.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Process for assembling steam generators having a vertically extending boiler structural steelwork, a roof having an inner roof section and an outer roof section, a boiler wall having multiple portions, and interior components, the process comprising the steps of:

(a) constructing portions of the boiler wall at a first area of the installation site and simultaneously constructing the interior components at a second area of the installation site that is vertically below the first area while the interior components are suspended:

(b) positioning the interior components between the portions of the boiler wall; and (c) fastening the interior components in position between the portions of the boiler wall.

2. Process according to claim 1, wherein step (a) includes the sub-steps of installing the portions of the boiler wall into an upper part of the boiler structural steelwork and constructing the interior components in a lower part of the boiler structural steelwork.

3. Process according to claim 2, wherein the steam generator also has a temporary cable hoisting system and step (b) includes the sub-steps of raising the interior components between the portions of the boiler wall into an assembly position and fastening the interior components in the assembly position.

4. Process according to claim 1, wherein before step (a), the process further comprises the steps of:

erecting the boiler structural steelwork and at least the outer roof section; and arranging a cable hoisting system on the outer section of the roof.

5. Process according to claim 4, further comprising the step of erecting tie bars and projections for portions of the boiler wall as the boiler structural steelwork is erected of immediately after the boiler structural steel work is erected.

6. Process according to claim 5, further comprising the steps of:

preassembling the buckstays and wall boxes; and transporting the preassembled buckstays and wall boxes to their place of installation or to a temporary installation place on the boiler structural steelwork.

7. Process according to claim 1, further comprising the steps of:

assembling the interior components under the inner section of the roof of the boiler structural steelwork;

suspending the interior components from the inner section of the roof; and raising the inner section of the roof and the suspended interior components stepwise according to the building progress.

8. Process according to claim 7 further comprising the step of connecting the inner and outer sections of the roof of the boiler structural steelwork after the interior components are raised into the assembly position.

9. Process according to claim 1, wherein step (a) includes the sub-steps of:

assembling the portions by registers, inserting the portions from above, suspending the portions into the boiler structural steelwork, aligning the portions, and welding the portions.

10. Process for assembling steam generators having a vertically extending boiler structural steelwork, a roof having an inner roof section and an outer roof section, a boiler wall having multiple portions, and interior components, the process comprising the steps of:

(a) erecting the boiler structural steelwork and at least the outer roof section;

(b) arranging a cable hoisting system on the outer section of the roof;

(c) constructing portions of the boiler wall at a first area of the installation site that is vertically below the first area:

(d) positioning the interior components between the portions of the boiler wall; and (e) fastening the interior components in position between the portions of the boiler wall.

11. Process for assembling steam generators having a vertically extending boiler structural steelwork, a roof having an inner roof section and an outer roof section, a boiler wall having multiple portions, and interior components, the process comprising the steps of:

(a) constructing portions of the boiler wall at a first area of the installation site and constructing the interior components at a second area of the installation site that is vertically below the first area and under the inner section of the roof:

(b) suspending the interior components from the inner section of the roof;

(c) raising the inner section of the roof and the suspended interior components stepwise according to the building progress;

(d) positioning the interior components between the portions of the boiler wall; and (e) fastening the interior components in position between the portions of the boiler wall.

* * * * *

UNITED STATES PATENT AND TRADEMARK OFFICE

CERTIFICATE OF CORRECTION

PATENT NO. : 6,588,104 B2
DATED : July 8, 2003
INVENTOR(S) : Heidrich

It is certified that error appears in the above-identified patent and that said Letters Patent is hereby corrected as shown below:

Column 8,
Line 41, after "for" insert -- the --.
Line 42, after "erected" delete "of" and replace with -- or --.

Column 9,
Line 16, after "site" insert -- and constructing the interior components at a second area of the installation site --.

Signed and Sealed this

Twentieth Day of July, 2004

JON W. DUDAS
*Acting Director of the United States Patent and Trademark Office*